US009061507B2

(12) United States Patent
Slomianny et al.

(10) Patent No.: US 9,061,507 B2
(45) Date of Patent: Jun. 23, 2015

(54) INKJET PRINTER FOR LABELING GOODS

(71) Applicant: EBS INK-JET SYSTEME GMBH, Numbrecht (DE)

(72) Inventors: Jan Slomianny, Numbrecht (DE); Andreas Slomianny, Numbrecht (DE)

(73) Assignee: EBS INK-JET SYSTEME GMBH (DE)

( * ) Notice: Subject to any disclaimer, the term of this patent is extended or adjusted under 35 U.S.C. 154(b) by 0 days.

(21) Appl. No.: 14/378,069

(22) PCT Filed: Jan. 31, 2013

(86) PCT No.: PCT/EP2013/051952
§ 371 (c)(1),
(2) Date: Aug. 11, 2014

(87) PCT Pub. No.: WO2013/120702
PCT Pub. Date: Aug. 22, 2013

(65) Prior Publication Data

US 2015/0015644 A1 Jan. 15, 2015

(30) Foreign Application Priority Data

Feb. 16, 2012 (DE) ..... 10 2012 202 343

(51) Int. Cl.
*B41J 2/175* (2006.01)
*B41J 3/36* (2006.01)

(52) U.S. Cl.
CPC ..... *B41J 2/17523* (2013.01); *B41J 2/17513* (2013.01); *B41J 2/1752* (2013.01); *B41J 2/1753* (2013.01); *B41J 2/17546* (2013.01); *B41J 3/36* (2013.01)

(58) Field of Classification Search
USPC ..... 347/86
See application file for complete search history.

(56) References Cited

U.S. PATENT DOCUMENTS

| | | | | |
|---|---|---|---|---|
| 6,404,995 | B1 * | 6/2002 | Kimizuka | 399/13 |
| 2003/0063147 | A1 | 4/2003 | Walker | |
| 2007/0040876 | A1 | 2/2007 | Anderson et al. | |
| 2007/0252858 | A1 | 11/2007 | Kyoshima | |
| 2009/0243857 | A1 | 10/2009 | Sunagawa et al. | |

FOREIGN PATENT DOCUMENTS

| | | | |
|---|---|---|---|
| EP | 0720916 | A2 | 7/1996 |
| EP | 0789322 | A2 | 8/1997 |
| EP | 1470924 | A1 | 10/2004 |
| EP | 1876025 | A1 | 1/2008 |
| WO | 8501104 | A1 | 3/1985 |
| WO | 9948694 | A1 | 9/1999 |
| WO | 2008024884 | A2 | 2/2008 |

OTHER PUBLICATIONS

International Search Report issued Mar. 14, 2013 re: PCT/EP2013/051952; citing: US 2009/243857 A1, US 2007/040876 A1, US 2003/063147 A1, US 2007/252858 A1, EP1 470 924 A1, EP 1 876 025 A1 and WO 2008/024884 A2.

* cited by examiner

*Primary Examiner* — Stephen Meier
*Assistant Examiner* — Alexander D Shenderov
(74) *Attorney, Agent, or Firm* — Cantor Colburn LLP

(57) ABSTRACT

An inkjet printer for the labeling of goods includes a main device having at least one outlet opening for ink, in particular for ink droplets, at least one storage container for a liquid flowing through the outlet opening, such as, for example, ink, pigments or solvents, the storage container being detachably connected to the main device, and liquid and mechanical couplings. The liquid coupling has a first coupling portion on the main device and a second coupling portion on the storage container. The mechanical coupling includes a first coupling means on the main device and a second coupling means on the storage container. The storage container further includes a ring-shaped transponder having a ring-shaped second antenna extending about the second coupling portion and a control unit storing data on the liquid contained in the storage container.

12 Claims, 3 Drawing Sheets

INKJET PRINTER FOR LABELING GOODS

FIELD

The disclosure relates to an inkjet printer for the labeling of goods, including a main device having at least one outlet opening for ink, in particular for ink droplets; at least one storage container for a liquid flowing through the outlet opening, such as, for example, ink, pigments or solvents, the storage container being detachably connected to the main device; a liquid coupling having a first coupling portion on the main device and a second coupling portion on the storage container, and a mechanical coupling having a first coupling portion on the main device and a second coupling portion on the storage container.

The disclosure relates, in particular, to inkjet printers in the form of handheld devices. Such handheld devices are self-sufficient; just like cordless screwdrivers, for example, they are independent from external supply lines, in particular power supply lines. Inkjet printers in the form of handheld devices frequently also have a similar shape to that of cordless screwdrivers. The outlet opening for ink is located where the bit is clamped into the cordless screwdriver. Most frequently, a power supply in the form of, for example, at least one rechargeable battery is accommodated in the grip of the inkjet printer configured as a handheld device. The storage container for the liquid used for printing is located at the rear of the main device axially opposite from the outlet opening. Its main device is preferably cap-shaped.

BACKGROUND

The inkjet printer is designed for the labeling of goods. It may work with a continuous inkjet; preferably, it works with ink droplets discharged from the outlet opening. During the writing process, the handheld device has to be moved relative to the labeled goods. Generally, the goods are stationary and the handheld device is moved relative to the goods in the writing direction. A roller, which rolls on the goods and which detects the relative speed of the writing motion, can be provided on the handheld device. The writing process is controlled in this manner.

Even if the present disclosure is preferably suitable for handheld devices, its use for stationary inkjet printers is not excluded.

Inkjet printers are known from the prior art. With regard to the prior art, reference is made to the following documents EP 1 064 153 B1, WO 85/01104, EP 720916 and EP 789322.

Efforts are being made to be able to transmit into the main device sufficient information on the at least one liquid located in the storage container. For example, it is desirable to detect, for example, the expiry date of this liquid, the type of liquid, the duration of use so far of the liquid for printing processes, and other information. This information is fed to a computer which is located in the main device and controls the operating processes of the printer. Because the storage containers are replaceable, it is possible to successively connect several different storage containers to a main device, in particular to replace storage containers. In most cases, different liquids, in particular inks and/or solvents, are required for the labeling of different goods. Because the storage container is replaceable, the inkjet printer can be rapidly adapted to different requirements, for example to printing on paper bags, glass bottles or pieces of textile.

According to the prior art, the information is transmitted between the storage container and the main device via electrical contacts, in particular contact pins. Their number should remain small. It was found that the electrical contacting is difficult and not satisfactory in the long run. It was also found that interruptions and errors during the establishment of the electrical contact between the pins and the mating contacts in the main device result in unwanted signals, interruptions and other errors in transmission.

Thus, there is a desire for avoiding the drawbacks of the previously known inkjet printer and providing a more reliable transmission of the information on the liquid located in the storage container to components controlling the operating processes, in particular to a computer.

SUMMARY

This object is achieved by an inkjet printer for the labeling of goods comprising

- a main device having at least one outlet opening for ink, in particular for ink droplets,
- at least one storage container for a liquid flowing through the outlet opening, such as, for example, ink, pigments or solvents, the storage container being detachably connected to the main device,
- a liquid coupling having a first coupling portion on the main device and a second coupling portion on the storage container, and
- a mechanical coupling having a first coupling portion on the main device and a second coupling portion on the storage container, in this case, the storage container comprises a ring-shaped transponder having an antenna extending about the second coupling portion and a storage device in which data on the liquid contained in the storage container are stored.

In this way, a direct, immediate connection to the ring-shaped transponder is obtained independently from the condition of the mechanical coupling and the respectively reached position between the main device and the storage container. Preferably, a basic unit cooperating with the transponder and disposed in the main device is disposed in the immediate vicinity of the transponder and preferably coaxially therewith. Preferably, the transponder has a second ring-shaped antenna having an arbitrary ring-shaped form. It has a sufficiently free region inside, so that there remains enough room for the liquid coupling. Preferably, the basic unit has a ring-shaped first antenna configured in a manner similar to the second antenna and located in the immediate vicinity of the latter. In particular, the first antenna of the basic unit and the second antenna of the transponder are preferably disposed coaxially. Due to the immediate closeness, a stable, secure connection is obtained. The connection requires only little energy because the parts are immediately adjacent. Thus, energy can be transmitted with a high degree of efficiency via the ring-shaped first antenna into the ring-shaped second antenna in order to supply the transponder with power.

In a preferred embodiment, the coupling portions of the liquid coupling are made from non-conductive material, in particular plastic. They are preferably disposed on a single axis.

Preferably, the storage container comprises a collapsible bag in which the liquid, in particular ink, is located. The storage container is accessible only via the second coupling portion; it is tightly connected with that.

Preferably, the second coupling portion has a valve that is normally automatically closed and closes the access to the bag if the first coupling portion is not connected to the second coupling portion.

Preferably, the storage container has a housing sealed in an air-tight manner, whose interior is accessible only via a hole in a container wall.

Preferably, an air pressure generating unit is provided in the main device, whose outlet communicates with an air passage and which communicates with an interior of the storage container when the storage container is placed on the main device.

It is possible to combine individual coupling devices with each other, e.g. to integrate the mechanical coupling and the liquid coupling into a single coupling.

DETAILED DESCRIPTION OF THE DRAWINGS

Figure 1:
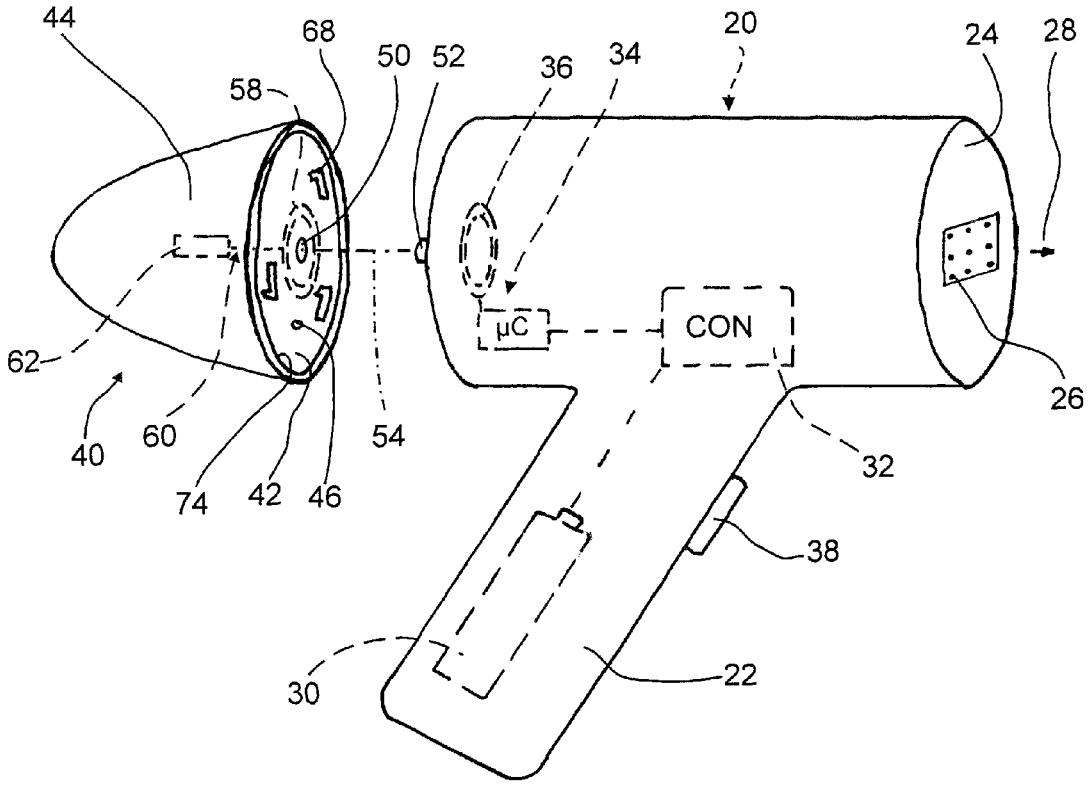
FIG. 1: shows a perspective view of an inkjet printer as an assembly view with a main device and a storage container located at a distance therefrom.
Figure 2:
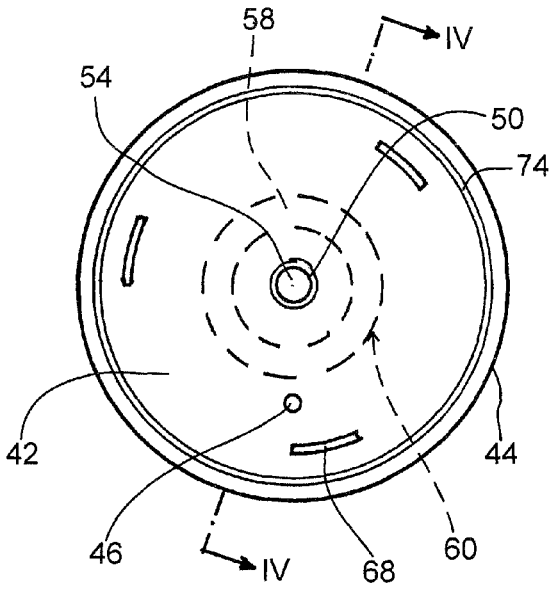
FIG. 2: shows a view in the axial direction, viewed from the plane of separation in FIG. 1, onto the storage container.
Figure 3:
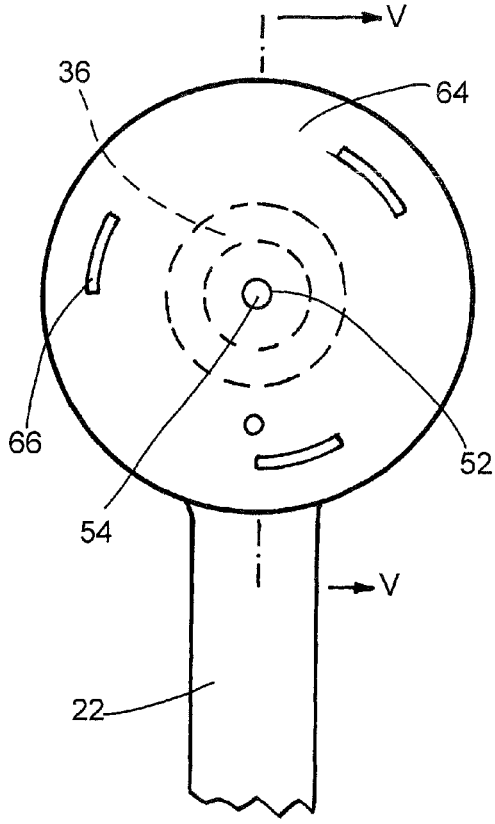
FIG. 3: shows an axial view, viewed from the plane of separation and in an opposite viewing direction to FIG. 2, onto the main device.

The inkjet printer for the labeling of goods according to the exemplary embodiment is designed as a handheld device. It comprises a main device 20, which in this case is configured to be substantially cylindrical with an attached grip 22. A front face 24 is located on the right-hand side of the main device 20; several outlet openings 26 for ink 49 are provided there. The ink discharge takes place in accordance with the arrow 28. Printing is preferably done with ink droplets. A power supply 30 is accommodated in the grip 22; it is depicted as a rechargeable battery. It is connected to a control device CON 32 that controls all operating processes. In turn, this control device 32 is electrically connected to a basic unit μC 34; this basic unit 34 has a ring-shaped first antenna 36. A trigger 38 is attached in the grip 22; a printing process is triggered with it.

Figure 5:
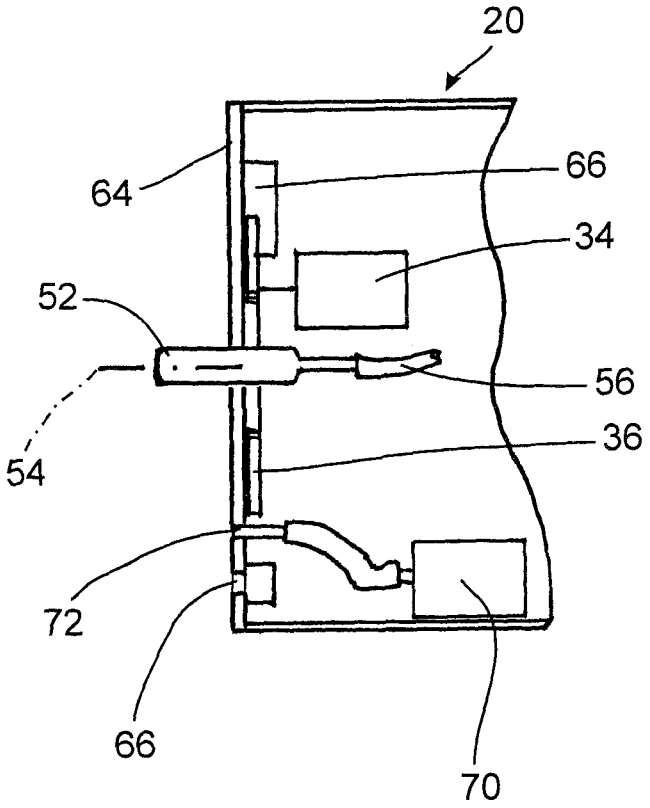

Separated by a plane of separation, a storage container 40 is located to the left, next to the main device 20. It has its own housing. It is delimited by a plane container wall 42 having the shape of a circular disk and by a cap 44. The two are connected to each other in an air-tight manner. The interior delimited by them communicates with the environment only via one hole 46. A bag 48 for ink 49 is located in this interior. It is made from a foldable thin material, for example from a plastic film. Its inner volume varies with the filling quantity of ink 49, is filled completely with ink 49 and is connected to the outer surroundings only via a second coupling portion 50. This second coupling portion 50 is configured as a bushing and cooperates with a first coupling portion 52 which protrudes on the main device 20 transversely to the plane of separation and is configured as a plug. In the assembled state, the two coupling portions 50, 52 enable a liquid-tight connection. The two coupling portions 50, 52 are rotationally symmetric to an axis 54. As FIG. 5 shows, the first coupling portion 52 is connected, within the main device 20, to an ink tube 56. The interior of the bag 48 is accessible via this ink tube 56 only when the two coupling portion 50, 52 are connected to each other.

Figure 4:
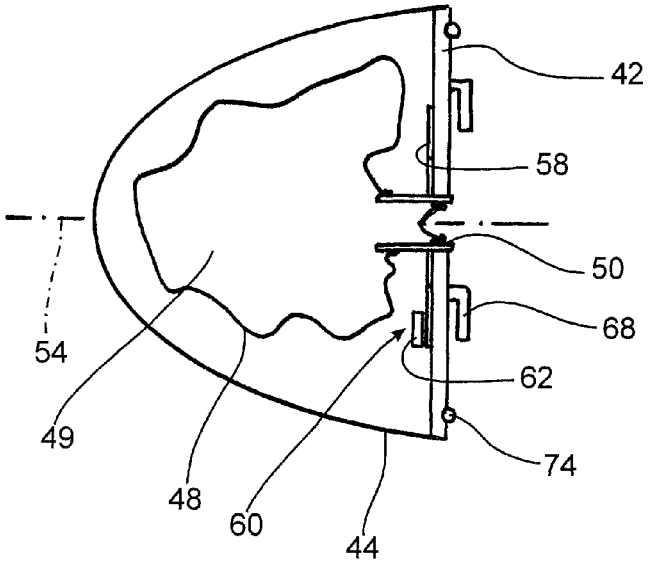
FIG. 4: shows a sectional view of the storage container along a sectional plane IV-IV in FIG. 2, and FIG. 5: shows a partial sectional view along the sectional plane V-V in FIG. 3 for an end portion of the main device.

The second coupling portion 50 is configured in such a way that it seals even if the first coupling portion 52 is not located in the second coupling portion 50. It is thus ensured that the interior of the bag 48 is closed off when the coupling 50, 52 is opened and thus separated, as this is shown in FIG. 1. FIG. 4 shows a corresponding self-sealing valve. The latter preferably also establishes a seal at the same time between the two coupling portions 50, 52, when the coupling 50, 52 is engaged.

A ring-shaped second antenna 58 of a transponder 60 is attached to the inner face of the container wall 42. Furthermore, a control unit 62 is associated with this transponder 60. This transponder 60 cooperates with the basic unit 34 and is adapted and attuned thereto. Such cooperating units comprised of a basic unit 34 and a transponder 60 are known from the prior art; reference is made to U.S. Pat. No. 7,520,429 B2; U.S. Pat. No. 4,862,160 A and US 2009/016049 A1. Such units comprised of a basic unit 34 and a transponder 60 are frequently also referred to as RFID systems. In this case, the term "reader" is also used for the basic unit 34. However, the basic unit 34 not only reads but also transmits information to the transponder 60 and receives responses from it. Thus, it is capable both of transmitting and receiving. In the present case, the transponder 60 is a so-called passive transponder; it has no power supply of its own. It is also supplied with energy by the basic unit 34. In this case, it is advantageous that the antennas 36, 58 of the two devices are preferably coaxial and have substantially the same radial extent. This is shown in the Figures.

Data on the ink 49 in the bag 48 are stored in the control unit 62; these data include the expiry date of the ink 49 or other liquid, its type, composition, initial quantity and current quantity or removed quantity of ink 49. Other features can be stored. If the respective current quantity of ink 49 is known, it is possible to work with different ink containers 40, i.e. to replace them during operation. This is necessary, for example, when printing with a different color is desired. The RFID systems are standardized in accordance with ISO-18000-1. Reference is made to this standard.

Instructions by means of which the data contained in the control unit 62 can be compared and processed are stored in the control device 32 and/or in the basic unit 34. If, for example, the expiry date of the ink 49 has been exceeded, no printing process is enabled; rather, a corresponding message, e.g. a flashing red indication, is preferably triggered. If the current supply in the bag 48 is relatively low so that it may possibly no longer suffice for a printing process, this is either indicated or the printing process is blocked. Also the other data are processed or used in this sense. In this regard, reference is made to the three European patents and the WO publication already mentioned above.

Three hooks protrude on the ink container 40; together with correspondingly configured recesses formed in an air-tight manner in an end wall 64 of the main device 20, they form a mechanical coupling device. The recesses are an exemplary embodiment for a first coupling means 66; the hooks are an exemplary embodiment for the second coupling means 68 of the mechanical coupling. Other configurations of the coupling means are possible. For example, one coupling means can be configured as an external thread, the other as an internal thread. It is also possible to configure the coupling means 66, 68 as a click connection. A kinematic reversal is possible.

If, in the exemplary embodiment shown, the antennas 36, 58 are each configured and depicted as ring-shaped disks, this is not to be understood as limiting. The antennas 36, 58 may also have other shapes; they can, for example, form a polygon or be configured in an oval or star shape. The only important thing is that they leave an inner space free that is sufficiently large for a coupling portion 50 or 52 to be disposed there.

Preferably, the container wall 42 and the end wall 64 are delimited towards the outside by a circular line that is centrical with respect to the axis 54. This is realized in this manner in the exemplary embodiment. Preferably, the mechanical coupling works by means of a rotary movement over a certain angle range, e.g. 10 to 40°. It is preferably configured as a bayonet-type connection, as this is indicated in the exemplary embodiment.

As is shown in FIG. 5, a compressor 70 or other suitable air pressure generating unit is located within the main device. Devices as they are used e.g. in portable blood pressure measuring devices are being used. The compressor is controlled by the control device 32 and is connected thereto. Its outlet-side pressure line is connected via a tube to an air passage 72 that leads through the end wall 64. A seal 74 is disposed between the end wall 64 and the container wall 42; in the exemplary embodiment, it is fixed to the container wall 42. It comes into contact with the end wall 64 when the ink container 40 is mounted to the main device 20. The air passage 72 is located within this seal 74. If the compressor 70 is switched on, it puts the intermediate space between the end wall 64 and the container wall 42 under overpressure. Via the hole 46, this intermediate space is also connected to the interior of the ink container 40. The hole 46 is located within the circumference of the seal 74. Thus, an overpressure is also created in the interior. Due to this overpressure 48, the bag is compressed; the ink 49 is thus under an overpressure. A valve which is not shown here, which is disposed behind the ink tube 56 and controls e.g. the printing process and is a customary component of an ink printer, blocks the ink and lets it flow towards the outlet opening 26 if the valve is opened. The printing process is made possible in this manner. Other printing processes are possible, for example using a piezo-element. Because of the overpressure in the ink container 40, it is ensured that the ink 49 can be transported at least into the main device 20 without having to suction or otherwise convey the ink 49.

In a kinematic reversal, the hooks forming the second coupling portion 50 in the exemplary embodiment shown are formed in another embodiment on the end wall 64, and the first coupling portion 52 is formed on the container wall 42. In that case, it is no longer necessary to form the first coupling portion 52 in a recess-shape and, thus, in an air-tight manner. Rather, the first coupling portion 52 can now take over the function of the hole 46. This is subject to the coupling portions 50, 52 still being disposed within the circumference of the seal 74.

It is also possible to dispose the coupling portion 50, 52 outside the circumference of the seal 74; in that case, this results in the advantage that an air-tight configuration of the recesses is not necessary.

The above-described assembly comprised of the air passage 72, the seal 74 and an opening, such as the hole 46, forms, in addition to the liquid coupling with the coupling portions 50, 52 and the mechanical coupling with the coupling means 60, 68, a third coupling, i.e. an air coupling, via which compressed air can be transferred from the main device 20, to be precise from the air passage 72, into the ink container 40.

The invention claimed is:

1. An inkjet printer for the labeling of goods, comprising
a main device having at least one outlet opening for droplets,
at least one storage container for a liquid flowing through the outlet opening the storage container being detachably connected to the main device,
a liquid coupling having a first coupling portion on the main device and a second coupling portion the storage container, and
a mechanical coupling having a first coupling means on the main device and a second coupling means on the storage container, wherein the storage container includes a ring-shaped transponder having a ring-shaped second antenna extending around the second coupling portion and a control unit storing data on the liquid contained in the storage container.

2. The inkjet printer according to claim 1, wherein at least the second coupling portion, is made from non-conductive material.

3. The inkjet printer according to claim 1, wherein the main device has an end wall, wherein: the storage container has a container wall, and, in the assembled state of the storage container on the main device the first coupling means and the second coupling means are in a coupling contact, and that the transponder is located on an inner face of the container wall and a ring-shaped second antenna of a basic unit is located on an inner face of the end wall.

4. The inkjet printer according to claim 1, wherein the storage container comprises a collapsible bag in which the liquid is located, and that the bag has an opening tightly connected to the second coupling portion.

5. The inkjet printer according to claim 1, wherein the mechanical coupling has a seal that connects the storage container to the main device in an air-tight manner.

6. The inkjet printer according to claim 1, wherein an air passage is provided in a container wall of the storage container, and that an air pressure generating unit whose outlet communicates with the air passage is provided in the main device.

7. The inkjet printer according to claim 1, wherein only a single collapsible bag and/or only a single liquid is contained in the storage container.

8. The inkjet printer according to claim 1, wherein a control device controlling the operating processes is accommodated in the main device.

9. The inkjet printer according to claim 1, wherein the transponder is configured as an RFID.

10. The inkjet printer according to claim 1, wherein a basic unit is provided, cooperating with the transponder, and connected to a power supply disposed in the main device and to a control device disposed in the main device and controls the operating processes, the basic unit is disposed in the main device and in the immediate vicinity of the transponder.

11. The inkjet printer according to claim 1, wherein a rotary movement is provided, the rotary movement is attached to the mechanical coupling for its actuation, that the movement of the rotary movement takes place about an axis, and that the liquid coupling is disposed centrically relative to this axis.

12. The inkjet printer according to claim 1, characterized in that the liquid flowing through the outlet opening is at least one of ink, pigment and solvent.

* * * * *